US005522103A

United States Patent [19]

Kier et al.

[11] Patent Number: 5,522,103

[45] Date of Patent: Jun. 4, 1996

[54] COLLAPSIBLE BED PAN/BODY SUPPORT SYSTEM FOR MAINTAINING DESIRED RELATIVE ORIENTATION OF A BEDRIDDEN PATIENT'S LEGS, HIPS AND SPINE

[76] Inventors: Loretta J. Kier, P.O. Box 438, Harleysville, Pa. 19438; Charlene H. Kirkner, 4039 Skippack Pike, Skippack, Pa. 19474

[21] Appl. No.: 498,890

[22] Filed: Jul. 6, 1995

[51] Int. Cl.[6] ..... A47C 1/037; A47C 4/00

[52] U.S. Cl. ..... 5/630; 128/845; 5/648; 5/449

[58] Field of Search ..... 5/81.1, 604, 463, 5/449, 654, 453, 624, 648, 650, 632, 926; 128/882, 869, 877, 845, 846

[56] References Cited

U.S. PATENT DOCUMENTS

| | | | |
|---|---|---|---|
| 211,741 | 1/1879 | Johnson | 5/449 |
| 1,981,666 | 11/1934 | Ridley | 5/453 |
| 3,532,336 | 4/1968 | Bater | 5/624 |
| 4,805,605 | 2/1989 | Glassman | 128/882 |
| 4,949,409 | 8/1990 | Stefano | 5/463 |
| 5,125,123 | 1/1992 | Engle | 128/882 |

*Primary Examiner*—Steven N. Meyers
*Assistant Examiner*—Fredrick Conley
*Attorney, Agent, or Firm*—Terry M. Gernstein

[57] ABSTRACT

A system for supporting a bed ridden patient while that patient uses a bed pan includes a body-supporting section and a foot-supporting section which co-operate with each other to maintain a proper and desired relative orientation among the patient's legs, hips and spine. The body-supporting section is inflatable, and the fully-inflated height of the body-supporting section is greater than the height of the foot-supporting section to provide versatility to the system. The body-supporting section is coated with lubricant to facilitate sliding that section under a patient.

5 Claims, 2 Drawing Sheets

COLLAPSIBLE BED PAN/BODY SUPPORT SYSTEM FOR MAINTAINING DESIRED RELATIVE ORIENTATION OF A BEDRIDDEN PATIENT'S LEGS, HIPS AND SPINE

TECHNICAL FIELD OF THE INVENTION

The present invention relates to the general art of bedding and bed accessories, and to the particular field of bed accessories for use by bed-ridden patients.

BACKGROUND OF THE INVENTION

Post operative recuperation for many patients often involves a long period of confinement to a bed. Some patients are able to leave their bed to relieve themselves. However, some patients must remain in bed, and such patients require the use of a bed pan. This situation can be uncomfortable for many patients, but can be detrimental to the recovery of others.

For example, patients who have undergone hip surgery, or the like, may need special care and special procedures when using a bed pan. Hip replacement surgery is one of the most prevalent operations today. Some estimate that there are as many as one hundred thousand such operations performed each year. Such patients may be required to remain supine for long periods of time, and should not move out of certain prescribed orientations so the femur bone of the repaired or replaced hip does not release from the hip socket, or any screws in the repaired or replaced hip loosen. A Foley catheter should not be used because this catheter may cause infections that may get into the hemovac site, which goes to the center of the bone. Therefore, such patients must use a bed pan to void. Such patients often void because IVs are running post-operative for hydration purposes and filtration of the blood from the hemovac site is taking place. However, improper alignment among the patient's hips, legs and spine can result in the above-mentioned problems associated with the repaired hip. In addition to hip surgery, other procedures that may require lengthy periods of supine bed ridden recovery as well as proper relative alignment between a patient's legs, hips and spine, include: cranial surgery, abdominal surgery, Lammy, Lammy fusion, skeletal traction and some eye surgery, cerebral vascular accident victims, pelvic external fixations and those associated with neck, head and chest injuries where chest tubes might be invalid. In addition, some recovery is often carried out at home; however, the home recovery associated with such procedures often requires the same body alignments.

Therefore, in these circumstances, it is often very important that the patient's hips, legs and spine remain properly oriented with respect to each other. This makes using a bed pan, even one that is can be used without leaving the supine position, difficult.

While the art includes several devices that can elevate a bed-ridden supine patient's hips for using a bed pan, the inventors are not aware of any device which ensures total patient leg, hip and spine alignment during such activity.

Still further, many patients differ in their needs and comfort level during recovery. In fact, a single patient may have varying needs during his or her recovery period. Therefore, even during use of a bed pan, there should be some means for customizing the device used for each particular situation.

Therefore, there is a need for a system which not only supports a supine patient's hips during use of a bed pan, but also maintains proper relative alignment among the patient's legs, hips and spine, and which is easy to use and is easily and widely adjustable so it is amenable to both hospital and home use for a variety of situations.

Still further, in many situations, it is extremely uncomfortable, and perhaps dangerous, for a patient to be turned during some parts of a recovery period. Many bed pan units known to the inventors require the patient to be turned or otherwise to have his or her hips moved in order to place the bed pan beneath the patient.

Therefore, there is a need for a bed pan system which can be placed under a patient without having to turn the patient.

OBJECTS OF THE INVENTION

It is a main object of the present invention to maintain a desired relative orientation and alignment among the legs, hips and spine of a bed-ridden patient during use of a bed pan.

It is another object of the present invention to permit a bed ridden patient to use a bed pan without unduly endangering a fusion between that patient's femur bone and the associated hip socket.

It is another object of the present invention to maintain a desired relative orientation and alignment among the legs, hips and spine of a bed-ridden patient during use of a bed pan and which is easily used in either a hospital or in a home.

It is another object of the present invention to maintain a desired relative orientation and alignment among the legs, hips and spine of a bed-ridden patient during use of a bed pan and which is easily applied to use for a bed-ridden patient.

It is another object of the present invention to maintain a desired relative orientation and alignment among the legs, hips and spine of a bed-ridden patient during use of a bed pan and which can be adjusted for the most effective orientation of the patient's legs, hips and spine.

It is another object of the present invention to provide a bed pan system that can be efficiently placed under a patient without having to turn the patient.

It is a specific object of the present invention to maintain a desired relative orientation and alignment among the legs, hips and spine of a supine bed-ridden patient during use of a bed pan.

It is another specific object of the present invention to maintain a desired relative orientation and alignment among the legs, hips and spine of a supine bed-ridden patient during use of a bed pan with the maximum height of the body-supporting section being five inches.

SUMMARY OF THE INVENTION

These, and other, objects are achieved by a system which includes a body-supporting section which slides under a supine patient's hips and a foot-supporting section which is placed beneath that patient's feet. The body-supporting section is covered with a lubricant to facilitate this sliding whereby the body-supporting section can be placed under the patient without having to turn the patient. The body-supporting section tapers in a diverging direction from a headend to a footend to gradually elevate the patient's hips. The foot-supporting section has a height that is selected so the patient's feet are oriented with respect to the patient's supported hips to force the heads of the patient's femur bones into their associated hip sockets. This keeps a hip surgery patient's hips from coming out of their sockets or from screws becoming loosened. The foot-supporting section also keeps the patient's feet separated from each other, and protects the patient's feet from pressure of the bed. The body-supporting section can be inflated as much as is required to produce the desired alignment among the patient's feet, legs and spine. The inventors have found that there is at least one ideal relationship, such as during recovery from hip surgery, among these body portions for bed pan use by a supine patient, has the patient's hips elevated above the level of the patient's feet. Therefore, the system of the present invention has the height above the bed surface of the body-supporting hip-supporting surface at maximum inflation is greater than the height above the bed surface of the foot-supporting section foot-supporting surface. By controlling the inflation of the body-supporting section, the feet can even be elevated above the patient's hips if desired. This relationship permits a health care provider to adjust these relative heights by controlling the amount of inflation of the body-supporting section. This adjustability feature provides the ability to make the patient as comfortable as possible during his or her recuperation, even if the patient's needs change during this recuperation. This feature also permits the system to be customized for each patient. The inventors have found that the ideal maximum height for the body-supporting section is five inches as this height represents the best balance between the competing factors of storability, controllability, cost, ease of placement and inflation, and others, and still provides enough height to permit a wide range of foot positions relative to the hip position to permit customizing the system for each patient, and even for each stage of the individual patient's recovery, or even for a use-to-use preferences.

BRIEF DESCRIPTION OF THE DRAWING FIGURES

DETAILED DESCRIPTION OF THE PREFERRED EMBODIMENT OF THE INVENTION

Figure 1:
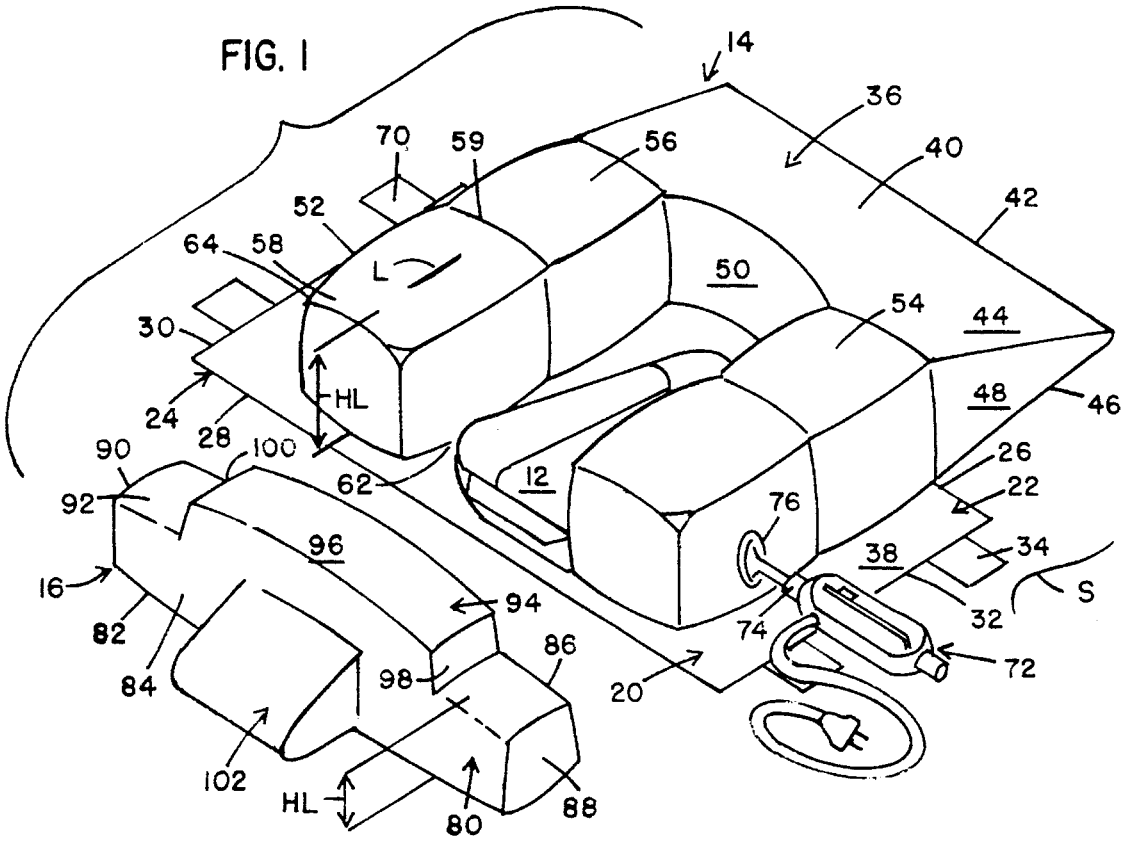
FIG. 1 is a top, front and side perspective view of the system embodying the present invention in the inflated condition.
Figure 2:
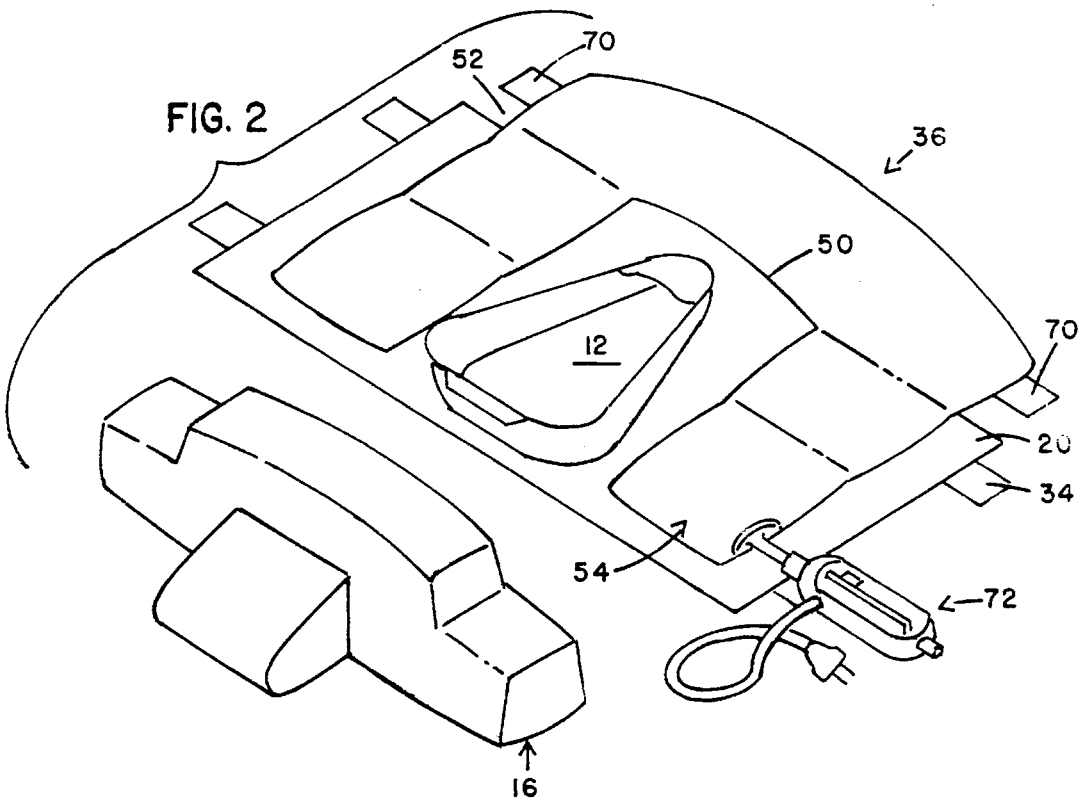
FIG. 2 is a top, front and side perspective view of the system embodying the present invention in the deflated condition.
Figure 3:
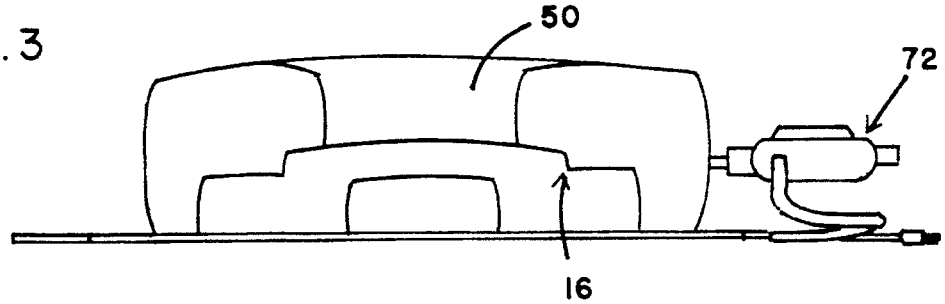
FIG. 3 is a front elevational view thereof.
Figure 4:
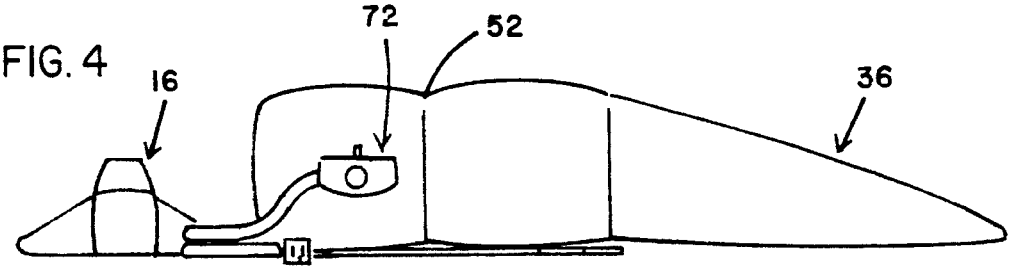
FIG. 4 is a side elevational view thereof, the side opposite being a mirror image of the side shown in FIG. 4.
Figure 5:
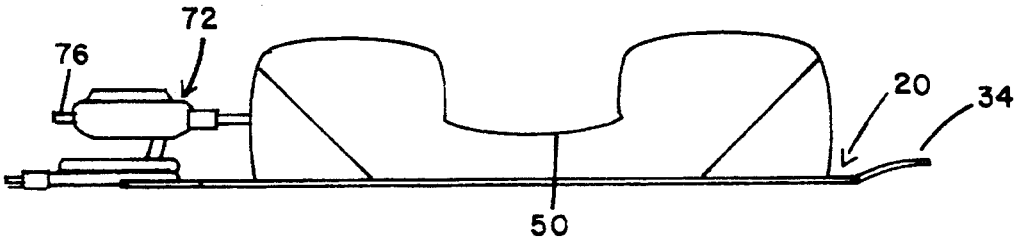
FIG. 5 is a back elevational view of the body-supporting section in the inflated condition.

Shown in FIG. 1 is a collapsible bed pan/leg support system 10 for maintaining a desired relative orientation between a supine bedridden patient's legs, hips and spine during use of a bed pan 12. System 10 includes a body-supporting section 14 and a foot-supporting section 16. The two sections 14 and 16 are arranged, sized and shaped to co-operate to align a supine patient's legs, hips and spine when that patient is using bed pan 12 whereby that patient's hips are forced into a position that is not only comfortable but will not endanger the results of hip surgery. That is, the patient's feet are oriented with respect to the patient's hips and spine so the patient's femur bones are forced toward that patient's hip sockets. This prevents loosening of screws or the like during use of a bed pan. It also maintains a proper and desired orientation of the patient's spine with respect to the other parts of his or her body during bed pan use. As will be discussed below, the sizes and dimensions of body-supporting section 14 can be adjusted with respect to foot-supporting section to achieve these results for various patients and even for a single patient on different uses of bed pan 12. In this manner, sections 14 and 16 co-operate with each other to achieve the just-described results.

Specifically, body-supporting section 14 includes a planar base section 20 having a headend 22 and a footend 24. It is noted that directions will be disclosed with respect to a supine patient using system 10. Planar base section 20 also includes a headend edge 26 and a footend edge 28 which are connected to two side edges 30 and 32. Handle means, such as handles 34, are fixed to each side edge for moving the planar base section with respect to a bed surface S and/or under a patient.

Section 14 further includes an inflatable portion 36 fixed to top surface 38 of section 20. Inflatable portion 36 includes a central section 40 having a headend edge 42 at which are connected top surface 44 and bottom surface 46. Side surfaces 48 are also defined on section 40. As shown in FIG. 1, in the inflated condition, section 40 is triangular in shape with headend edge 42 forming the apex of the triangle. Section 40 further includes an arcuate central side 50. Two legs 52 and 54 are connected to section 40 adjacent to the arcuate section at a proximal end of each leg and extend away from section 40 towards the foot end of the system. The legs are identical, and each includes two portions 56 and 58 which are joined together at a waist 59 to define a scalloped shape. The scalloped shape contacts the user and provides comfort for a user. A distal end 60 of each leg is located adjacent to footend edge 28, with the proximal end of each leg being located adjacent to headend edge 26 whereby the legs extend for essentially the entire width of planar section 24 between edges 24 and 26. This provides support for the legs and thus provides support for a user since the planar section is secured to the bed.

Each leg has a bottom 62 secured to the planar base and a top 64 spaced from the planar base by height dimension HB of each leg. The preferred form of system 10 includes a height dimension HB equal to five inches. The inventors have found that this height satisfies several requirements, as discussed above. This height dimension varies according to the amount of inflation of the legs as will be understood by one skilled in the art based on the teaching of this disclosure.

Section 40 is connected to the proximal ends of the legs adjacent to headend edge 26 and extends away from that headend edge so section 36 is not supported by planar base 20. A handle means, such as handle 70 can be fixed to the bottom surface of section 36 to move section 36 if desired.

The body supporting section includes lubricating means for permitting that section to be easily and efficiently slid under a patient without having to turn the patient. The lubricating means is indicated in FIG. 1 at L, and the preferred lubricating means is Dri-Lub® Compounded Teflon Finish, sold by PCM Co of 1431 Ferry Ave., Camden, N.J. 08104. To further facilitate this sliding, the body-supporting section is inflatable so it can be easily inserted beneath a patient, and then inflated to the amount desired to maintain the above-discussed alignment among the patient's body parts. Therefore, inflatable portion 36 is hollow so it can accept inflating gas, such as air, and includes an inflating means 72 to conduct such inflating gas from a source to the interior of the portion 36. Means 72 can, itself, be a compressor, or a means to fluidically connect the system to a wall-located air source, and includes a valve 74 fluidically connected into a valve 76 which, in turn, is connected to portion 36 to conduct pressurizing fluid to the interior of the inflatable portion. Valve 74 is electronically operated and controlled. It is noted that a compressor will be used for home use whereas a hospital may have a source of pressurizing fluid connected to a valve in a wall of the hospital room. Therefore, hospital use may not require the compressor.

Foot-supporting section 16 includes a rectangular base 80 having a bottom 82 which rests on the bed surface, a footend surface 84, a headend surface 86, two sides 88 and 90 and a top 92 which is spaced above the bottom by height dimension HF of the base. Height dimension HF of the foot-supporting section is less than the fully-inflated height dimension HB of the body-supporting section. Therefore, in the preferred form of the system, height HF is less than five inches. This relationship between the height dimensions permits the patient to orient his or her feet in the most suitable orientation with respect to the remainder of his or her body for all circumstances. Adjusting the inflation of the body-supporting section permits the patient's body to be positioned in any suitable orientation with respect to the patient's feet due to this height relationship. At least one desired relative orientation will have the patient's hips located so that placement of the patient's feet on top 92 will force the patient's femur bones into their associated hip sockets.

Foot-supporting section 16 further includes a rectangular raised portion 94 on top 92. Portion 94 has a top surface 96 which is spaced above top 92 and two side surfaces 98 and 100 which are spaced from sides 88 and 90 respectively to define shoulders on the section 16. A patient's feet abut the shoulders and are kept separated from each other by raised portion 94. In addition to this separation, the patient's feet are also kept off of the bed surface which are both important considerations if a patient is bed ridden for great lengths of time.

Figure 6:
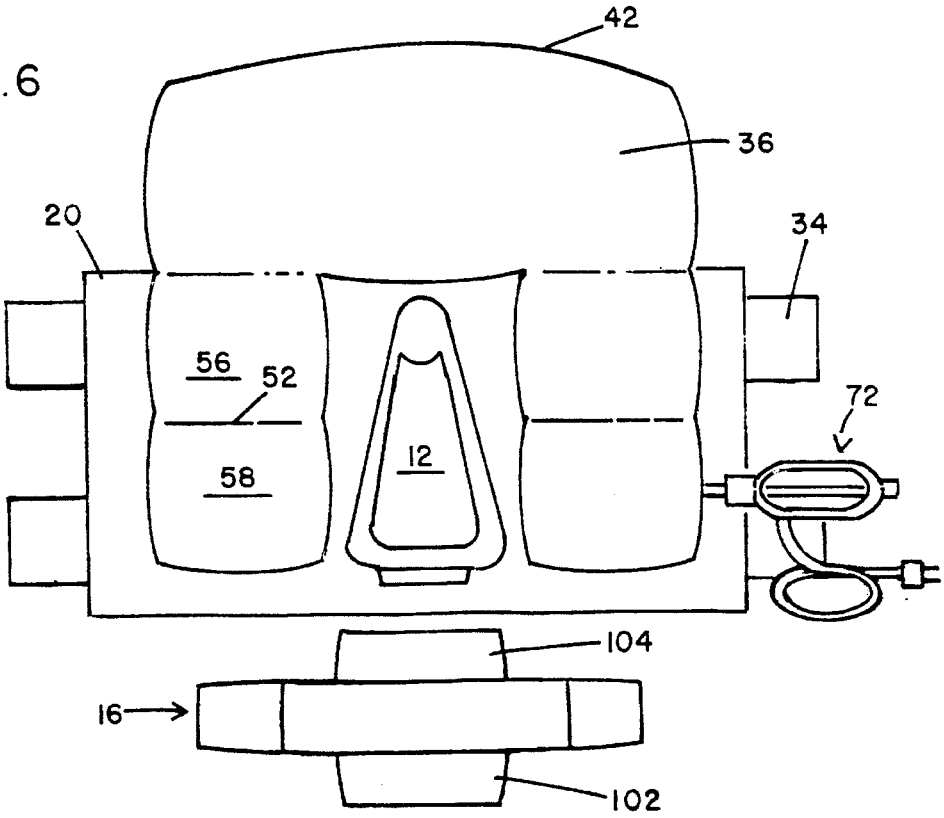
FIG. 6 is a top plan view of the system.

Foot-supporting section 16 also includes two identical triangular support sections, such as section 102 shown in FIG. 1. Section 102 is fixed to footend surface 84 and its corresponding section 104 is fixed to headend surface 86 as shown in FIG. 6. The support sections 102 and 104 have bottom surfaces that are co-planar with each other and with bottom 82 to rest on the bed. Special anchoring is not needed for the foot-supporting section due to the relationship of the heights HB and HF because, when using the bed pan, a patient will force his or her feet down toward the bed surface at an angle that tends to fix the foot-supporting section in place without the need of special handles such as straps 34 or 70 which can be used to move or lift the system or portions thereof. However, if desired, straps such as straps 34 and 70 can be included either on sides 88 and 90, or on support sections 102 and 104.

As shown in FIG. 1, the bed pan is positioned between the two legs 52 and 54 and rests on the planar base 20 for use and for easy removal.

It is understood that while certain forms of the present invention have been illustrated and described herein, it is not to be limited to the specific forms or arrangements of parts described and shown.

We claim:

1. A collapsible bed pan/leg support system for maintaining a desired relationship among the legs, hips and spine of a bed-ridden patient comprising:

A) a body-supporting section having a headend and a footend and including (I) a planar base for resting on a bed surface, said base including a headend edge, a footend edge and two side edges, (II) handle means on each of said side edges for moving said body-supporting section, (III) an inflatable portion fixed to said base including (a) a central section having a headend edge, a top surface and a bottom surface, said surfaces being joined together at the headend edge of said central section, side surface, each of which is triangular with an apex at the headend edge of said central portion when said inflatable portion is inflated, and an arcuate central side, (b) two legs each being connected at a proximal end thereof to said central section adjacent to said arcuate central side, each leg including two portions and a waist section connecting said two portions together, a distal end located adjacent to the footend edge of said planar base, each of said leg portions having its proximal end located adjacent to the footend edge of said planar base with said central section extending from adjacent to the headend edge of said planar base away from said base and the headend edge of said central section being spaced from the headend edge of said planar base, each leg having a bottom on said planar base, a top for engaging a patient's body and a height dimension measured between the leg portion top and bottom, and (c) lubricating means on said inflatable portion for facilitating the sliding of said body-supporting section under a patient without requiring the patient to be turned; and B) a foot-supporting section including (I) a rectangular base having a bottom surface which rests on the bed surface, a footend surface, a headend surface, two sides, a top surface, and a height dimension measured between the foot-supporting section bottom and top surfaces, the height dimension of said foot-supporting section being less than the height dimension of said legs when said legs are fully inflated for pushing the head of the patient's femur bones toward the associated hip sockets when using a bed pan, (II) a rectangular raised portion on the top surface of said rectangular base, said raised portion having a top which is spaced above the top surface of said rectangular base when said rectangular base rests on the bed surface, and two side surface member each of which is spaced from the sides of said rectangular base to define shoulders on said foot-engaging section for separating the patient's feet from each other, and (III) two support sections, one connected to the headend surface of said rectangular base and another connected to the footend surface of said rectangular base.

2. The support defined in claim 1 further including means connected to one of said legs for inflating the inflatable portion of said body-supporting section.

3. The support defined in claim 2 further including a bed pan on said planar base between said two legs.

4. The support defined in claim 1 wherein said body-supporting height is five inches.

5. The support defined in claim 1 wherein said lubricating means includes Teflon material.

* * * * *